US009551109B2

(12) United States Patent
Draper et al.

(10) Patent No.: US 9,551,109 B2
(45) Date of Patent: Jan. 24, 2017

(54) DOCTOR BLADE INCLUDING COMBINATION CARBON/GLASS YARNS

(71) Applicant: Kadant Inc., Westford, MA (US)

(72) Inventors: Michael David Draper, Wigan (GB); Kevin Callus, Stonyhurst (GB); Ka Lun To, Manchester (GB)

(73) Assignee: KADANT INC., Westford, MA (US)

( * ) Notice: Subject to any disclaimer, the term of this patent is extended or adjusted under 35 U.S.C. 154(b) by 209 days.

(21) Appl. No.: 13/948,786

(22) Filed: Jul. 23, 2013

(65) Prior Publication Data

US 2014/0023846 A1 Jan. 23, 2014

Related U.S. Application Data

(60) Provisional application No. 61/674,545, filed on Jul. 23, 2012.

(51) Int. Cl.
*D21G 3/00* (2006.01)

(52) U.S. Cl.
CPC ..... *D21G 3/005* (2013.01); *Y10T 428/249949* (2015.04); *Y10T 428/2918* (2015.01); *Y10T 428/2929* (2015.01); *Y10T 428/2931* (2015.01); *Y10T 428/2964* (2015.01)

(58) Field of Classification Search
None
See application file for complete search history.

(56) References Cited

U.S. PATENT DOCUMENTS

| | | | | |
|---|---|---|---|---|
| 4,549,933 | A | 10/1985 | Judd et al. | |
| 4,622,192 | A * | 11/1986 | Ma | 428/408 |
| 5,055,242 | A | 10/1991 | Vane | |
| 5,227,236 | A * | 7/1993 | Handermann | 428/361 |
| 5,445,693 | A | 8/1995 | Vane | |
| 6,027,794 | A | 2/2000 | Ozaki et al. | |
| 6,294,036 | B1 | 9/2001 | Loubinoux et al. | |
| 6,416,843 | B1 | 7/2002 | Rata et al. | |
| 6,565,712 | B2 | 5/2003 | Lindenfelser | |
| 6,643,890 | B2 | 11/2003 | Carrier | |
| 6,867,155 | B2 | 3/2005 | Brauns et al. | |
| 7,138,345 | B2 | 11/2006 | Wadahara et al. | |
| 8,168,292 | B2 | 5/2012 | Morin | |
| 2002/0068162 | A1 * | 6/2002 | Carrier | 428/297.4 |
| 2005/0172444 | A1 | 8/2005 | Carrier | |
| 2005/0279478 | A1 * | 12/2005 | Draper et al. | 162/280 |
| 2007/0052134 | A1 | 3/2007 | Draper et al. | |

FOREIGN PATENT DOCUMENTS

| | | | |
|---|---|---|---|
| WO | WO 99/12726 | A | 3/1999 |
| WO | WO 2007/036606 | A | 4/2007 |
| WO | WO 2010/146227 | A | 12/2010 |

OTHER PUBLICATIONS

International Search Reportand Written Opinion issued by European Patent Office for corresponding international application PCT/US2013/051668 dated Oct. 17, 2013.

* cited by examiner

*Primary Examiner* — David Sample
*Assistant Examiner* — Donald M Flores, Jr.
(74) *Attorney, Agent, or Firm* — Frommer Lawrence & Haug LLP

(57) ABSTRACT

A fiber reinforced composite material containing a polymeric resin matrix reinforced by fabrics consisting of co-mingled glass/carbon yarns for a doctor blade.

29 Claims, 1 Drawing Sheet

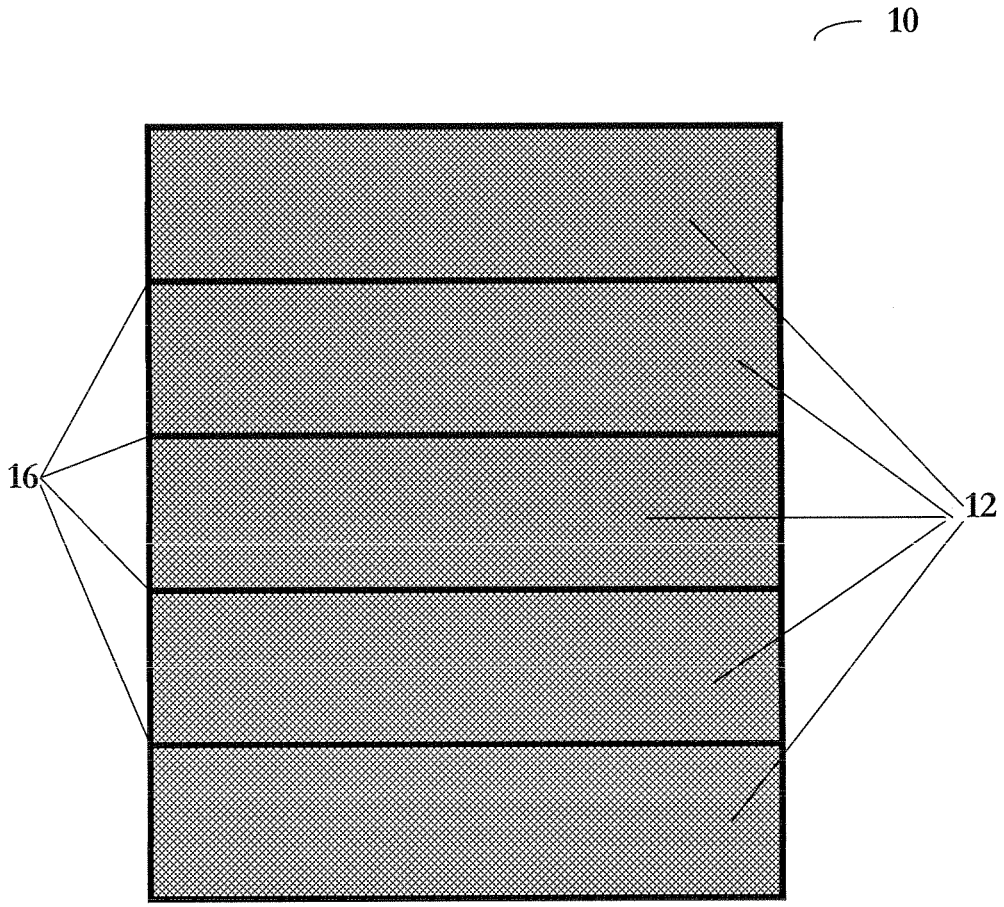
10
16
12

DOCTOR BLADE INCLUDING COMBINATION CARBON/GLASS YARNS

BACKGROUND OF THE INVENTION

1. Field of the Invention

The present invention relates generally to doctor blades used in papermaking and web converting machines 2. Description of Related Art Doctor blades contact the surface of rolls in papermaking and web converting machines for the purpose of cleaning or sheet removal. Conventional doctor blade materials include metals, plastic, and cotton, glass, and carbon thermoset and thermoplastic laminates.

For example, doctor blades are traditionally comprised of fabric substrates held together by polymeric resins, with the combination of substrate and resin providing the desired properties for efficient doctoring. Typical substrates include glass, cotton and carbon, whilst both thermoset and thermoplastic resins are used to hold the substrates together, and impart specific properties. Thermoset resins, e.g., epoxy resins, tend to be harder wearing, whilst high performance thermoplastic resins, such as polyphenylene sulphide (PPS) tend to be able to withstand higher machine temperatures and are less susceptible to chemical attack. A bevel edge is machined into the polymer composite to produce an angled slant at the tip of the blade to aid roll cleaning or sheet removal. The sharper and cleaner this edge is, the more efficient the performance of the doctor blade. Doctor blades made from many different materials are known. See U.S. Pat. No. 4,549,933, the entirety of which is incorporated by reference herein, which describes a doctor blade for a paper machine consisting of a number of alternating layers of fiber and carbon fiber with the fiber layers consisting of cotton, paper, fiberglass, or equivalents thereof.

In traditional fiber-reinforced composite doctor blades, the fibers are comprised of cotton, glass, or carbon fibers. These fibers are grouped into fiber bundles and then woven with half the fibers in the direction parallel to the paper machine and half in the direction perpendicular to the paper machine. The vast majority of woven fabrics have the same material in both directions. These fabrics are then impregnated with resin, and a number of pre-pregged fabrics are stacked up and subsequently compression molded to form the doctor blade. The different types of fibers provide different advantages and disadvantages for doctor blades. Carbon fibers, while expensive, provide excellent wear resistance and high strength if the fibers are placed in one direction. Glass fibers can provide very good cleaning of roll surfaces. Cotton fibers will provide acceptable performance in some applications at a very reasonable cost.

To gain the benefit of the different fibers, fiber-reinforced composite, manufacturers will often apply different layers of fabrics into composite products. A doctor blade composition, for example, may have 4 distinctive layers of glass fabric and 6 distinctive layers of carbon fabric. One of the disadvantages with having different layers is that there are often bond strength concerns, and fabric layers separate from one another, causing contaminates to build up in the separated area, ultimately resulting in failure of the doctor blade material. Another concern with this type of composition is that the doctor blade is not homogeneous throughout the thickness. For example, in use on a machine, the doctor blade's glass layer(s) wears through at a much faster rate than its carbon layer(s), which has a significantly longer life. Accordingly, in use over time, a doctor blade's glass layer wears through first, while the carbon layer of the blade wears comparatively slowly, resulting in changing performance as the doctor blade wears on the machine.

In recent years, there have been some developments of hybrid fabrics, in which one fiber type is woven in one direction and a different fiber type is woven in the other direction. While this type of arrangement seeks to realize the benefit of two types of fibers, only one type of fiber is directed towards the roll surface, so only one fiber is truly working to clean the roll. Additionally, the fibers in different directions cause a difference in the flexural properties of the material.

SUMMARY OF THE INVENTION

Disclosed are to doctor blades for use in papermaking and web converting machines, including a composite doctor blade comprising reinforcement fabrics made with combination glass/carbon yarns, wherein a combination glass/carbon yarn comprises a combination of carbon material and glass material. Doctor blades can be constructed from glass/carbon combination yarns, which may be monofilaments, a sheath-core yarn, and/or multifilament combination glass/carbon yarns made with more than one filament plied and/or ply/twisted together or commingled glass/carbon yarns. Combination glass/carbon yarns may also be knitted or braided. Systems and methods for forming multi-component yarns are known in the art and for the sake of brevity are not described herein.

In embodiments described herein, the doctor blade comprises the combination glass/carbon yarns comprising commingled glass/carbon yarns.

Also disclosed are commingled yarns including commingled yarns selected from the group of (1) glass/carbon/high performance thermoplastic (HPT), (2) Glass/HPT, and (3) carbon/HPT.

Disclosed is a doctor blade, used for roll cleaning, made from reinforcing fabrics comprising of commingled glass/carbon yarns in which glass and carbon fibers are intimately combined together within the same yarn. Advantages for the doctor blade include benefits from the synergistic benefits of both carbon and glass fibers on the roll surface, which is not subject to the weak bond between separate layers of glass and carbon. Advantages also include a more homogeneous doctor blade that provides more steady state performance.

Disclosed is a fiber-reinforced composite doctor blade that contains a polymeric resin matrix reinforced by glass fibers and carbon fibers commingled into a single yarn. Each yarn comprises glass and carbon fibers that can be woven into a traditional fabric cloth, multi-axial fabric or be used as a unidirectional layer and subsequently impregnated with resin and processed on a laminate press, by pultrusion or other doctor blade manufacturing technique to produce a doctor blade comprising of reinforcement materials consisting of commingled yarns.

BRIEF DESCRIPTION OF THE DRAWINGS

FIG. 1 is a partial cross sectional view, with dimensions exaggerated for purposes of illustration, of a blade construction in accordance with an embodiment.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Methods for forming a commingled yarn for a doctor blade include separating a plurality of fibers of differing composition into individual filament components within a chamber. As described above the differing composition of the fibers include carbon and glass. The individual filament components are then intermixed by introducing hot air into the chamber. As a result of introducing hot air currents, the individual filament components get intimately mixed together. The mixed filament components are then brought together as a single fiber. The glass filaments, therefore, become randomly distributed in the commingled carbon-glass yarn. Systems and methods for forming multi-component and commingled yarns are known in the art and for the sake of brevity are not described herein. These commingled fibers can then be woven or stitched into potentially any type of reinforcement fabric, e.g. plain weave, twill, multiaxial, etc.

The yarns thus formed can be used to produce doctor blades with carbon and glass synergistically combined together in the same yarns and reinforcement fabrics.

With reference initially to FIG. 1, a doctor blade constructed in accordance with the present invention is shown at 10 comprises a composite of multiple layers 12 of resin-impregnated fabrics (commonly referred to as "pre-pregs"). The pre-pregs may comprise woven or non-woven commingled fibers can then be woven or stitched into potentially any type of reinforcement fabric, e.g. plain weave, twill, multiaxial, etc as described herein. In one example, a 400 gsm plain weave fabric with commingled yarns consisting of 40% carbon and 60% glass was produced. A five (5) layer laminate of this fabric with commingled yarns was made.

The layers 12 are impregnated with a resin. A representative resin dispersion is a bisphenol A type epoxy resin, but can include other conventional resins as known in the art. The resin interfaces at 16 serve to adhere the layers 12 together during lamination under conditions of elevated temperature and pressure in accordance with well known practices.

Other manufacturing methods for the planar element 10 known to those skilled in the art include pultrusion, resin injection, and reactive resin injection molding.

In an embodiment, disclosed is a doctor blade comprising commingled glass/carbon yarns. In another embodiment, the doctor blade comprises commingled glass/carbon, and high performance thermoplastic yarns. Embodiments include commingled glass/carbon/high performance thermoplastic yarns in any combination. For example, the doctor blade can further comprise commingled glass/high performance thermoplastic and carbon/high performance thermoplastic yarns. The high performance thermoplastics can include thermoplastics selected from PPS, PEEK, PEI, PPA, and other high performance thermoplastics known in the art. Advantages of the high performance thermoplastic material includes eliminating the need for solvent based resins, potentially making the yarns and the doctor blades made therefrom recyclable, and improving the chemical resistance of the doctor blades. Adding high performance thermoplastic components as part of the commingled yarn thus may reduce the need for solvent based resins, makes the blades recyclable, and improves the solvent and chemical resistance as compared to conventional doctor blade resins such as epoxy and phenolic.

As described above, conventional doctor blades have distinctive layers of different fabric reinforcements, such as carbon and glass. Carbon and glass have very different coefficients of thermal expansion:

$$\text{Carbon}=-9.1\times10^{-7}\ K^{-1}$$

$$\text{Glass}=+5\times10^{-6}\ K^{-1}.$$

So when resins are cured in conventional known doctor blade manufacturing processes, the distinctive glass layers expand whilst the carbon layers contract. The reverse occurs when the material cools: the glass layers contract whilst the carbon layers expand. The contrary expansions and contractions during curing and cooling stress the resin at a molecular level, which leads to weak inter-layer bonding.

In an embodiment, disclosed a doctor blade for use in a papermaking machine, comprising a fiber reinforced composite material containing a polymeric resin matrix reinforced by fabrics consisting of commingled glass/carbon yarns. The polymeric resin material can be an epoxy or a thermoplastic. In an embodiment, the percentage of carbon fibers to total fibers is about 5-95%.

In an embodiment, the percentage of glass fibers to total fibers is about 5-95%. In one embodiment, the fiber reinforced composite includes a percentage of carbon fibers of about 40% and the percentage of glass fibers of about 60%. The doctor blade can comprise a total thickness between about 0.3 mm and about 5.0 mm (0.01 inches" to about 0.25").

In an embodiment, the total thickness of the doctor blade is about 0.015" (inches) to about 0.250", for example about 0.040" to about 0.110" or between about 0.050" and about 0.080". The doctor blade can comprise two or more layers of the blade are comprised of glass and carbon commingled fibers. The remaining layers may comprise standard woven, unidirectional, or chopped mat fibers containing the glass, carbon, or another reinforcing fiber material or in some cases, no fiber at all, being a pure resin layer. In one embodiment, the fibers are oriented in both the machine and cross machine directions. In another embodiment, the fibers can be oriented substantially in the machine direction.

In an embodiment, the fiber reinforced composite further comprises high performance thermoplastic (HPT) yarns. The doctor blade can further comprise commingled yarns selected from the group of: commingled glass and HPT, commingled carbon and HPT, and commingled glass, carbon and HPT. Exemplary HPT includes conventionally known HPT including HPT selected from polyphenylene sulfide (PPS), polyether ether ketone (PEEK), polyetherimide (PEI), and polyphthalamide (PPA).

An exemplary advantage of the commingled fabrics described herein includes, inter alia, that layers of the doctor blade expand and contract to substantially the same extent at substantially the same time, which this eliminates the stress and weakness in the chemical bonds between the layers and leads to better inter-layer bonds and hence a better higher performance doctor blade.

Another exemplary advantage includes the fact that using layers of a commingled fabric produces a more homogeneous blade that leads to more consistent and more steady state performance. Conventional doctor blades wear quickly through layers of glass, then slowly through layers of carbon, quickly again through glass, slowly again through carbon, and quickly through glass yet again. In a doctor blade produced in accord with embodiments of commingled fiber reinforcement fabric as disclosed herein, the wear remains consistent throughout the construction since the blade is more homogeneous and gives steady state performance throughout its life. Therefore, the commingled fabric as described herein produces a blade with consistent performance throughout the lifetime of the blade.

In an embodiment, commingled fabrics can be held together or laminated with resins containing carbon nanotubes and/or nanoparticles for use in doctor blades and planar elements. Doctor blades and incorporation of nanoparticles into resins for use in planar elements such as doctor blades are described in U.S. patent application Ser. No. 11/148,624 entitled PLANAR ELEMENTS FOR USE IN PAPERMAKING MACHINES, the entirety of which is incorporated by reference herein. The nanoparticles can be selected from powders, grains, fibers and platelets. For instance, metallic nanoparticles can selected from the group consisting of metal oxides, carbides or nitrides, metallic complexes, ionic structures and covalent bonds. Non-metallic and/or covalent particles usable in doctor blades include clay particles, silicates, ceramic materials, glass particles, carbon black, fumed silica, calcium carbonate, carbon nanotubes and nanospheres of ceramic powders.

In one embodiment a doctor blade can comprise resins including nanoparticles comprising between about 0.5 to 75% by weight of said polymeric resin matrix, for example between about 5 to 20% by weight of said polymeric resin matrix or nanoparticles between about 10 to 15% by weight of said polymeric resin matrix. In an embodiment, the nanoparticles can comprise about 3% by weight of said polymeric resin matrix, wherein the nanoparticles comprise or consist essentially of carbon nanotubes.

In another embodiment the doctor blade can comprise resins including nanoparticles comprising between about 20% to about 40% by weight of said polymeric resin matrix, and wherein the nanoparticles comprise or consist essentially of silica nanoparticles. For example, the silica nanoparticles can be between about 30% to about 40% by weight of said polymeric resin matrix.

The doctor blade can comprise a composite of multiple fabric substrates impregnated with the polymeric resin matrix including nanoparticles. For example, fabric substrates can include film layers interposed therebetween, at least one of said fabric substrates and film layers being impregnated with the polymeric resin matrix including nanoparticles.

For example, referring the FIG. 1, the layers 12 can be impregnated with a resin containing a dispersion of nanoparticles, such as for example, carbon nanotubes and or silica nanoparticles. A representative resin dispersion is a bisphenol A type epoxy resin, with carbon nanotube nanoparticles added to and uniformly dispersed therein in an amount of 3% by weight of the resin matrix. The resin interfaces at 16 serve to adhere the layers 12 together during lamination under conditions of elevated temperature and pressure in accordance with well known practices.

Example

In one example, a 400 gsm plain weave fabric with commingled yarns consisting of 40% carbon and 60% glass was produced. A five (5) layer laminate of this fabric with commingled yarns was made. The laminate thus produced was exceptionally stiff and strong. The laminate was also very flat and straight and accordingly had no distortion. The laminate was not prone to delamination as the layers could not be peeled apart by a peel test, whereby a layer of the laminate is attached to a spring balanced scale and is pulled to cause the layer to peel, with the pull required to peel the layer being recorded.

A 1.8 mm commingled blade comprising the commingled yarns consisting of 40% carbon and 60% glass was tested on an in-house wear tester against two different types of conventional glass-carbon doctor blades (Carbovic and Carbotek 4) of the same thickness and carbon content. The test was conducted by running the test blades against a chilled cast iron roll running at a speed of 1570 m/minute (50 Hz) for 24 hours at a loading of 1.2 Bar.

The commingled blade showed less weight loss (0.58%) and improved resistance to wear as compared to conventional blade 1 (type 1) (0.82%) and conventional blade 2 (type 2) (1.41%).

Additionally the commingled blade showed lower initial frictional drag (15.7 Amps were required to maintain the roll speed of 1570 m/min)), compared to conventional blade type (1) (18.0 Amps were required to maintain the roll speed of 1570 m/min), and conventional blade type (2) (20.5 Amps were required to maintain the roll speed of 1570 m/min). Accordingly, this resulted in a lower energy demand on the roll in order to maintain the same roll speed.

The commingled blade also displayed improved steady state performance over the conventional blades, averaging 14.90 Amps after 10 minutes of testing and requiring only 13.9 Amps after 24 hour to maintain the set roll speed, compared to conventional blade type (1) (15.05 Amps average after 10 mins. and requiring 14.0 Amps after 24 hours) and conventional blade type (2) (17.62 Amps average after 10 mins. and requiring 14.2 Amps after 24 hours).

The commingled blade also showed improved performance on a peel test. With the comingled blade the surface layer could not be lifted, as compared to conventional blade type (1) where the surface layer was peeled at 7.3 lbs and conventional blade type (2) where the surface layer was lifted at 8 lbs, all on a 3" wide sample.

What is claimed is:

1. A doctor blade for use in a papermaking machine, comprising a fiber reinforced composite material containing a polymeric resin matrix reinforced by fabrics comprising combination glass/carbon yarns, wherein a combination glass/carbon yarn comprises combination glass/carbon fibers comprising a combination of carbon material and glass material, wherein the combination glass/carbon yarn does not include high performance thermoplastic fibers.

2. A doctor blade as claimed in claim 1 wherein the percentage of carbon fibers to total fibers is about 5-95%.

3. A doctor blade as claimed in claim 1 wherein the percentage of glass fibers to total fibers is about 5-95%.

4. A doctor blade as claimed in claim 3 wherein the fibers are oriented in both the machine and cross machine directions.

5. A doctor blade as claimed in claim 3, wherein the fibers are oriented substantially in the machine direction.

6. A doctor blade as claimed in claim 3 wherein the total thickness of the blade is about 0.015 inches to about 0.250 inches.

7. The doctor blade of claim 6 wherein the total thickness of the blade is about 0.040 inches to about 0.110 inches.

8. The doctor blade of claim 7 wherein the total thickness of the blade is about 0.050 inches to about 0.080 inches.

9. A doctor blade as claimed in claim 3, wherein the blade comprises one or more fabric reinforcement layers that are comprised of glass and carbon commingled fibers.

10. A doctor blade as claimed in claim 1 wherein the percentage of carbon fibers is about 40% and the percentage of glass fibers is about 60%.

11. A doctor blade as claimed in claim 1 wherein the polymeric resin material is an epoxy or thermoplastic.

12. A doctor blade as claimed in claim 1, further comprising: high performance thermoplastic material.

13. A doctor blade as claimed in claim 12, wherein the high performance thermoplastic material comprise fibers selected from the group of:

commingled glass fibers and high performance thermoplastic fibers;

commingled carbon fibers and high performance thermoplastic fibers; and commingled carbon fibers, glass fibers, and high performance thermoplastic fibers.

14. A doctor blade as claimed in claim 12, comprising: a high performance thermoplastic selected from polyphenylene sulfide (PPS), polyether ether ketone (PEEK), polyetherimide (PEI), and polyphthalamide (PPA).

15. A doctor blade as claimed in claim 1, wherein the blade further comprises: nanoparticles in the polymeric resin matrix.

16. The doctor blade of claim 15 wherein said nanoparticles are selected from the group consisting of powders, grains, fibers and platelets.

17. The doctor blade of claim 16 wherein said nanoparticles are metallic and selected from the group consisting of metal oxides, carbides or nitrides, metallic complexes, ionic structures and covalent bonds.

18. The doctor blade of claim 16 wherein said nanoparticles are non-metallic and/or covalent and selected from the group consisting of clay particles, silicates, ceramic materials, glass particles, carbon black, fumed silica, calcium carbonate, carbon nanotubes and nanospheres of ceramic powders.

19. The doctor blade of claim 15 wherein said nanoparticles are metallic and selected from the group consisting of metal oxides, carbides or nitrides, metallic complexes, ionic structures and covalent bonds.

20. The doctor blade of claim 15 wherein said nanoparticles are non-metallic and/or covalent and selected from the group consisting of clay particles, silicates, ceramic materials, glass particles, carbon black, fumed silica, calcium carbonate, carbon nanotubes and nanospheres of ceramic powders.

21. The doctor blade of claim 15 wherein said nanoparticles comprise between about 0.5 to 75% by weight of said polymeric resin matrix.

22. The doctor blade of claim 21 wherein said nanoparticles comprise between about 1 to 20% by weight of said polymeric resin matrix.

23. The doctor blade of claim 22 wherein said nanoparticles comprise between about 10 to 15% by weight of said polymeric resin matrix.

24. The doctor blade of claim 21 wherein said nanoparticles comprise about 3% by weight of said polymeric resin matrix, and wherein the nanoparticles consist essentially of carbon nanotubes.

25. The doctor blade of claim 21, wherein said nanoparticles comprise between about 20% to about 40% by weight of said polymeric resin matrix, and wherein the nanoparticles consist essentially of silica nanoparticles.

26. The doctor blade of claim 25 wherein said nanoparticles comprise between about 30% to about 40% by weight of said polymeric resin matrix.

27. The doctor blade of claim 15, wherein the blade comprises a plurality of said fabrics impregnated with said polymeric resin matrix.

28. The doctor blade of claim 15, wherein the blade comprises a plurality of said fabrics with film layers interposed therebetween, at least one of said fabric and film layers being impregnated with said polymeric resin matrix.

29. The doctor blade of claim 1, wherein the combination glass/carbon fibers comprise commingled glass fibers and carbon fibers.

* * * * *